US007064722B1

(12) United States Patent
Neel

(10) Patent No.: US 7,064,722 B1
(45) Date of Patent: Jun. 20, 2006

(54) DUAL POLARIZED BROADBAND TAPERED SLOT ANTENNA

(75) Inventor: Michael M. Neel, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/109,020

(22) Filed: Apr. 7, 2005

(51) Int. Cl.
*H01Q 13/10* (2006.01)

(52) U.S. Cl. ..... 343/767; 343/770; 343/872; 343/700 MS

(58) Field of Classification Search ..... 343/767, 343/770, 782, 872, 772
See application file for complete search history.

(56) References Cited

U.S. PATENT DOCUMENTS

| | | | | |
|---|---|---|---|---|
| 5,036,335 | A * | 7/1991 | Jairam | 343/767 |
| 6,842,154 | B1 * | 1/2005 | Apostolos | 343/767 |
| 2005/0012672 | A1 * | 1/2005 | Fisher | 343/767 |
| 2005/0110627 | A1 * | 5/2005 | Sabet et al. | 340/447 |

* cited by examiner

*Primary Examiner*—Trinh Vo Dinh
(74) *Attorney, Agent, or Firm*—David S. Kalmbaugh

(57) ABSTRACT

A dual polarized broadband, lightweight, low cost tapered slot antenna which has first and second radiating tapered slot antennas which are co-located and positioned perpendicular to one another. Each antenna includes a relatively thin dielectric substrate and a radiating metallic antenna element mounted on the upper surface of the dielectric substrate. A tapered notch area, which is centrally located, is etched away to expose the dielectric substrate. The tapered slot antennas allow for linear polarization, elliptical polarization and circular polarization.

20 Claims, 8 Drawing Sheets

DUAL POLARIZED BROADBAND TAPERED SLOT ANTENNA

BACKGROUND OF THE INVENTION

1. Field of the Invention

The present invention relates generally to microstrip fed, tapered slot antennas. More specifically, the present invention relates to a dual polarization microstrip fed, tapered slot antenna which provides dual vertical and horizontal polarizations and which operates over a continuous frequency range of 1.5 GHZ (gigahertz) to 18 GHZ.

2. Description of the Prior Art

There is currently a need by the military for a relatively inexpensive, lightweight antenna which will operate over a frequency range of 1.5 GHZ to 18 GHZ. There is a requirement that the antenna also provide for dual vertical and horizontal polarizations. Ideally, the cost of the antenna should not exceed two hundred dollars to manufacture in relatively small quantities.

Broadband antennas, which operate in the 1.5 to 20 GHZ range, and weigh up to 2 pounds are available from several manufacturers and normally perform quite well for their intended function, i.e. test and evaluation of high frequency military communications and weapons systems. These broadband antennas are very expensive often costing more than $5000.00. When a user needs a significant quantity of broadband antennas for test and evaluation or is operating on a limited budget, $5000.00 per antenna is a cost which may be prohibitive. This, in turn, may result in either a limited test and evaluation of a communications or weapons system which is critical to the military, or a cancellation of a military weapons development program because of cost which exceed funds allocated to the program. If a lightweight, broadband antenna is required, no commercial antenna currently available may be satisfactory to the user.

Accordingly, there is an urgent need for an inexpensive antenna which costs approximately $200.00 to manufacture, operates over a broad frequency range and provides for dual vertical and horizontal polarizations.

SUMMARY OF THE INVENTION

The present invention overcomes some of the difficulties of the prior art broadband antennas including those mentioned above in that it comprises a compact, lightweight, low cost antenna providing dual vertical and horizontal polarizations and a continuous operational frequency range of 1.5 GHZ to 18 GHZ.

The present invention includes first and second radiating tapered slot antennas which are co-located, orthogonally polarized and positioned perpendicular to one another. Each antenna includes a relatively thin dielectric substrate and a radiating metallic antenna element mounted on the upper surface of the dielectric substrate. A tapered slot area, which is centrally located, is etched away to expose the dielectric substrate. The tapered slot area includes a slot line positioned at the narrow end of the taper.

Mounted on the lower surface of the dielectric for each antenna is a microstrip feed line which electrically excites the slot line. The transition from the microstrip feed line to the slot line is a Y to Y transition. The Y to Y transition from the feed line to the slot line transforms electrical current to an electric field, while maintaining a 50 ohm to 100 ohm impedance match.

A first antenna of the two antennas has a slot cut down the centerline of the antenna, which allows the second antenna to be inserted perpendicular to the first antenna on the second antenna centerline.

The Y to Y transition point location is adjusted in each antenna feed line lengths to maintain phase balance between the antennas.

The broadband tapered slot antenna also has four dielectric side walls which surround the two perpendicular antennas and are the support structure for the two perpendicular antennas.

BRIEF WRITTEN DESCRIPTION OF THE DRAWINGS

DETAILED DESCRIPTION OF THE PREFERRED EMBODIMENT

Figure 1:
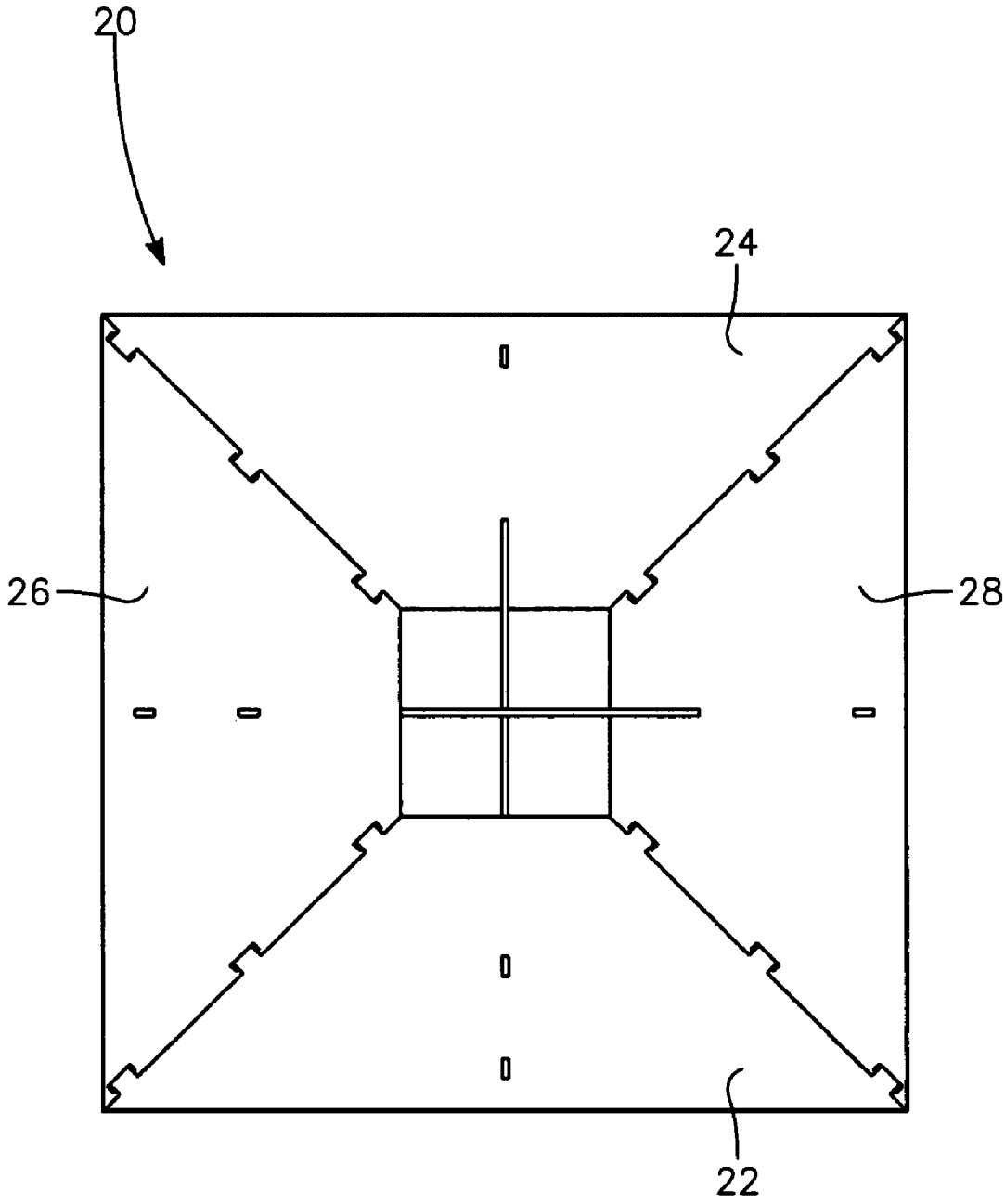
FIG. 1 is a view illustrating the support structure for the dual polarized broadband tapered slot antenna comprising the present invention.
Figure 3:
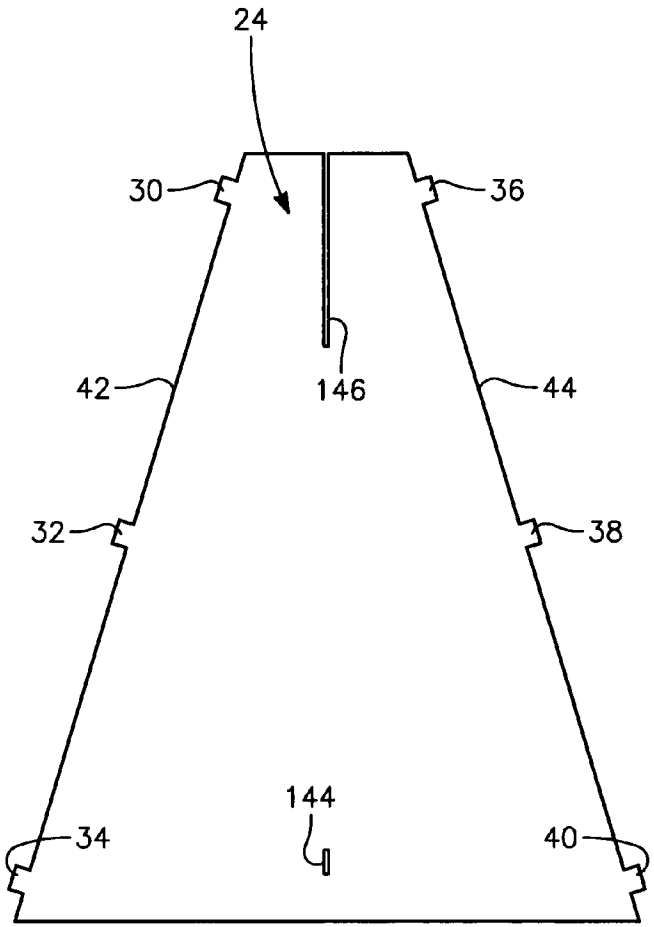
FIGS. 2–5 are views illustrating the four side walls which form the support structure for the dual polarized broadband tapered slot antenna of FIG. 1.
Figure 2:
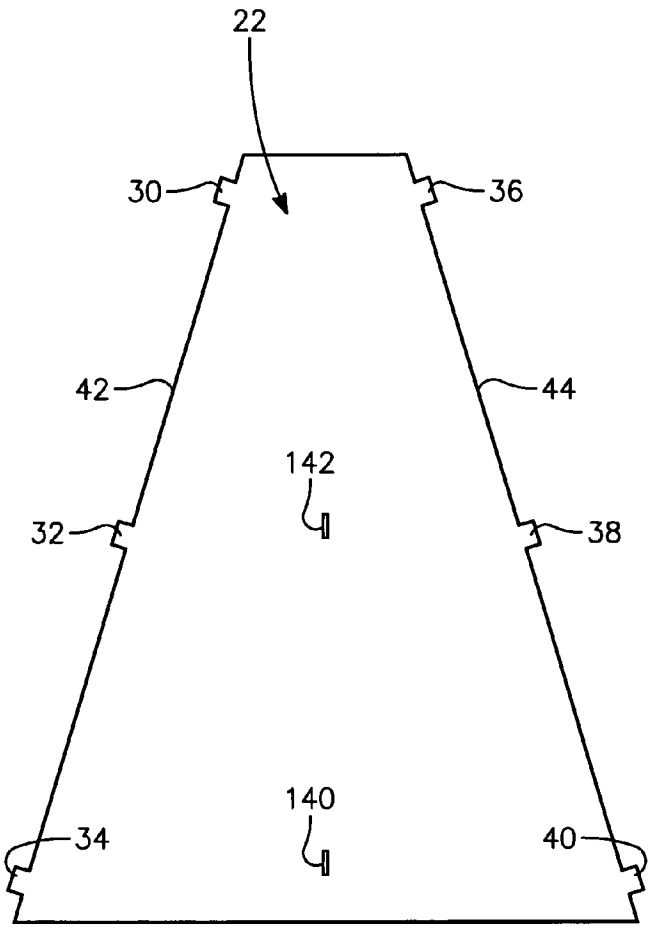
Figure 5:
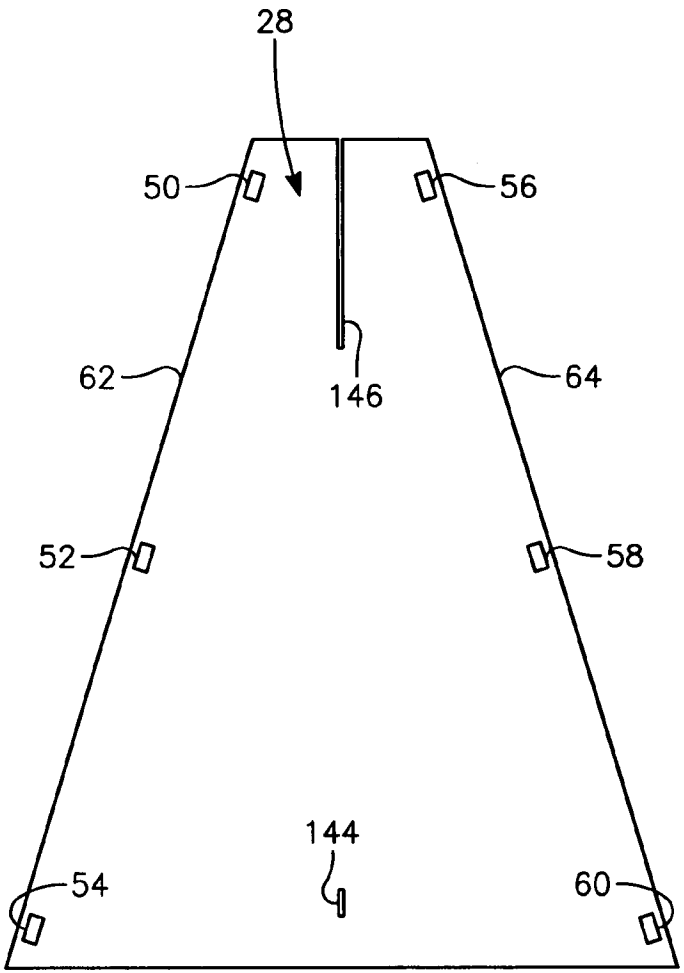
Figure 4:
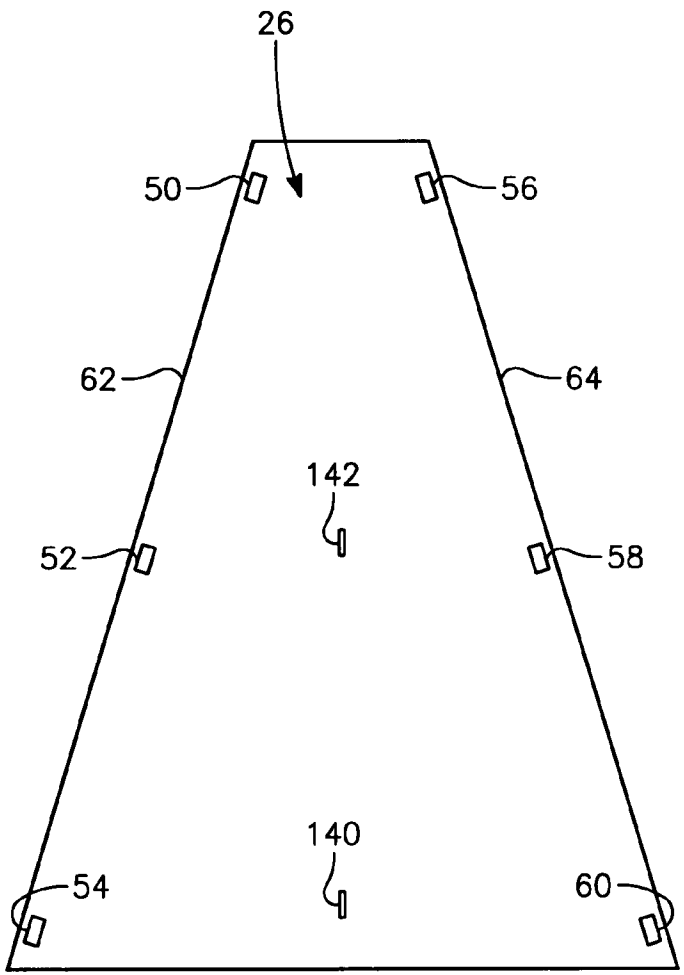

Referring to FIGS. 1–5, the antenna support structure, designated generally by the reference numeral 20 for the dual polarized broadband tapered slot antenna comprising the present invention includes four side walls 22, 24, 26 and 28 which are fabricated from dielectric boards commercially available from multiple manufactures. A dielectric material which may be used to fabricate the four side walls 22, 24, 26 and 28 of support structure is a high frequency laminate commercially available from Rogers Corporation of Rogers, Conn.

Each of the side walls 22, 24, 26 and 28 has the shape of a trapezoid. Sides walls 22 and 24 have six tabs 30, 32, 34, 36, 38 and 40 which extend from their non-parallel edges 42 and 44. Tabs 30 and 36 are located at the upper end of side walls 22 and 24; tabs 32 and 38 are located at the center of side walls 22 and 24; and tabs 34 and 40 are located at the lower end of side walls 22 and 24.

Similarly, side walls 26 and 28 have six rectangular shaped openings 50, 52, 54, 56, 58, and 60 which are positioned adjacent their non-parallel edges 62 and 64. Rectangular shaped openings 50 and 56 are located at the upper end of side walls 26 and 28; rectangular shaped openings 52 and 58 are located at the center of side walls 26 and 28; and tabs 54 and 60 are located at the lower end of side walls 26 and 28.

Each of the six tabs 30, 32, 34, 36, 38 and 40 on side walls 22 and 24 aligns with one of rectangular shaped opening 50, 52, 54, 56, 58, or 60 within side walls 26 and 28 to receive the tab 30, 32, 34, 36, 38 or 40. The tab 30, 32, 34, 36, 38 or 40 when inserted into the aligned rectangular shaped opening 50, 52, 54, 56, 58, or 60 secure side walls 22 and 24 to side walls 26 and 28 to form the antenna support structure 10 illustrated in FIG. 1. Antenna support structure 10 provides support for the microstrip antenna boards 66 and 68 (FIGS. 6 and 7) of the dual polarized broadband microstrip antenna comprising the present invention.

Figure 6:
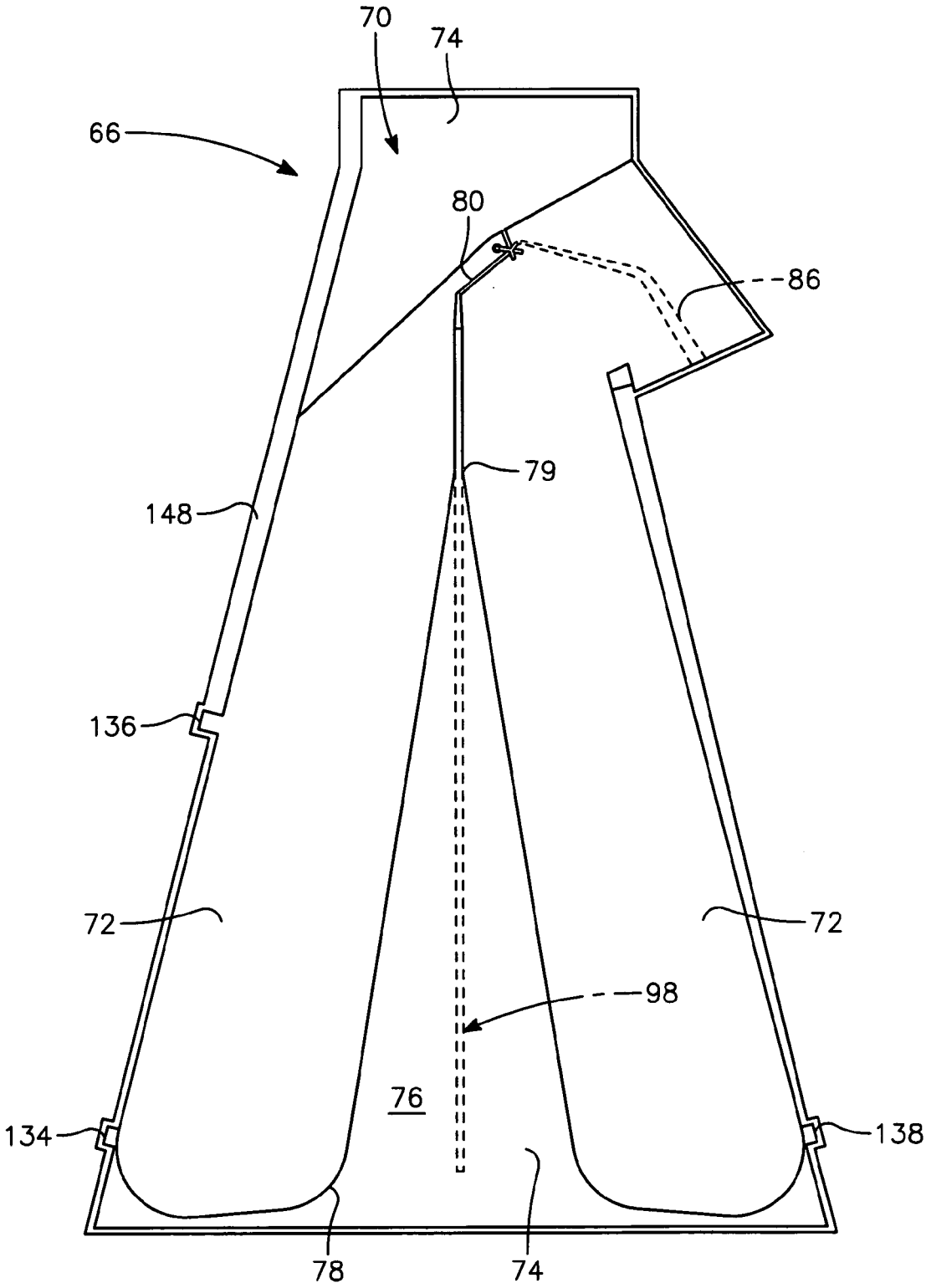
FIG. 6 is a view illustrating the first tapered slot antenna of the two radiating tapered slot antennas which form the dual polarized broadband tapered slot antenna of FIG. 1.
Figure 7:
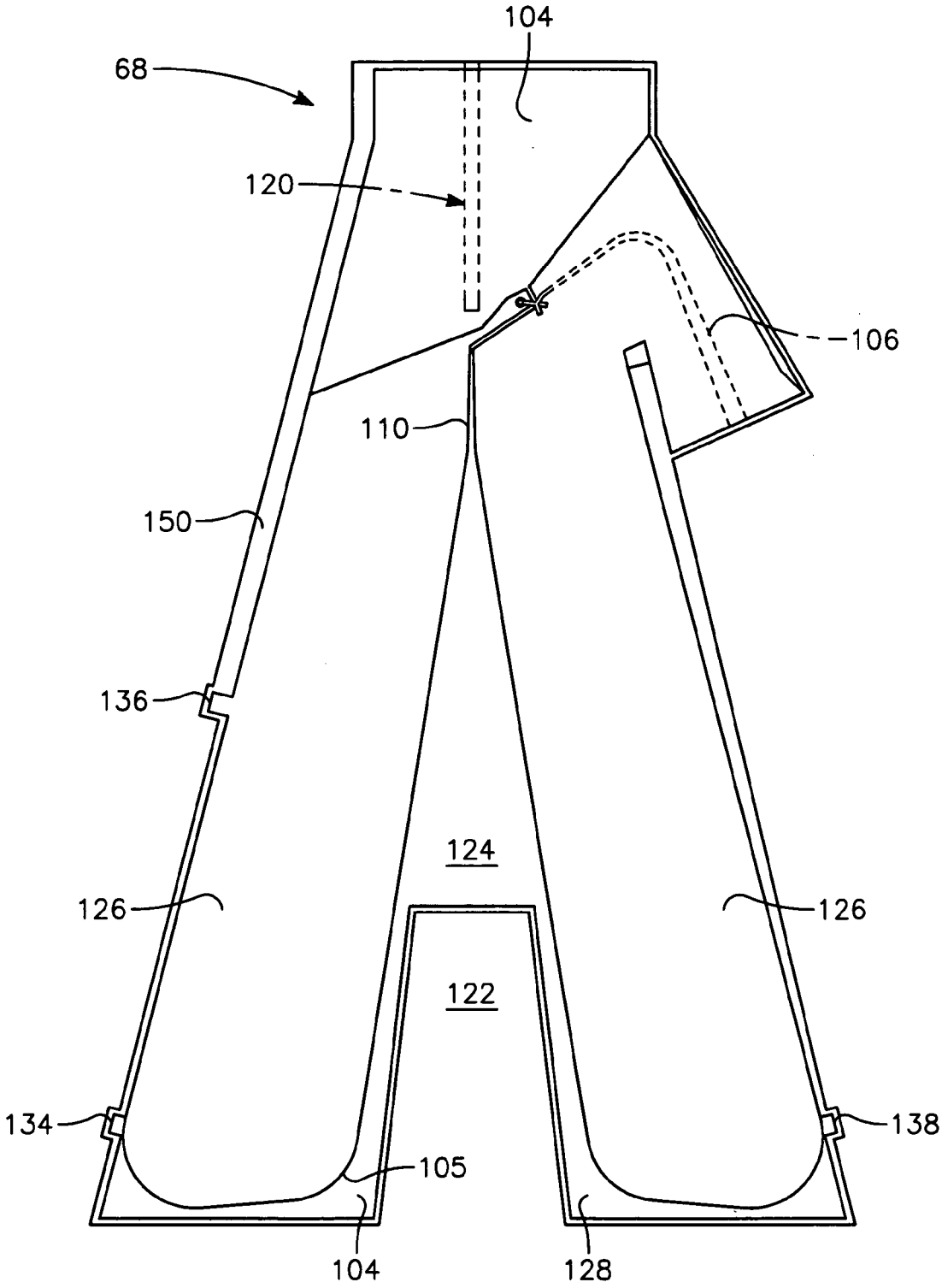
FIG. 7 is a view illustrating the second tapered slot antenna of the two radiating tapered slot antennas which form the dual polarized broadband tapered slot antenna of FIG. 1.
Figure 10:
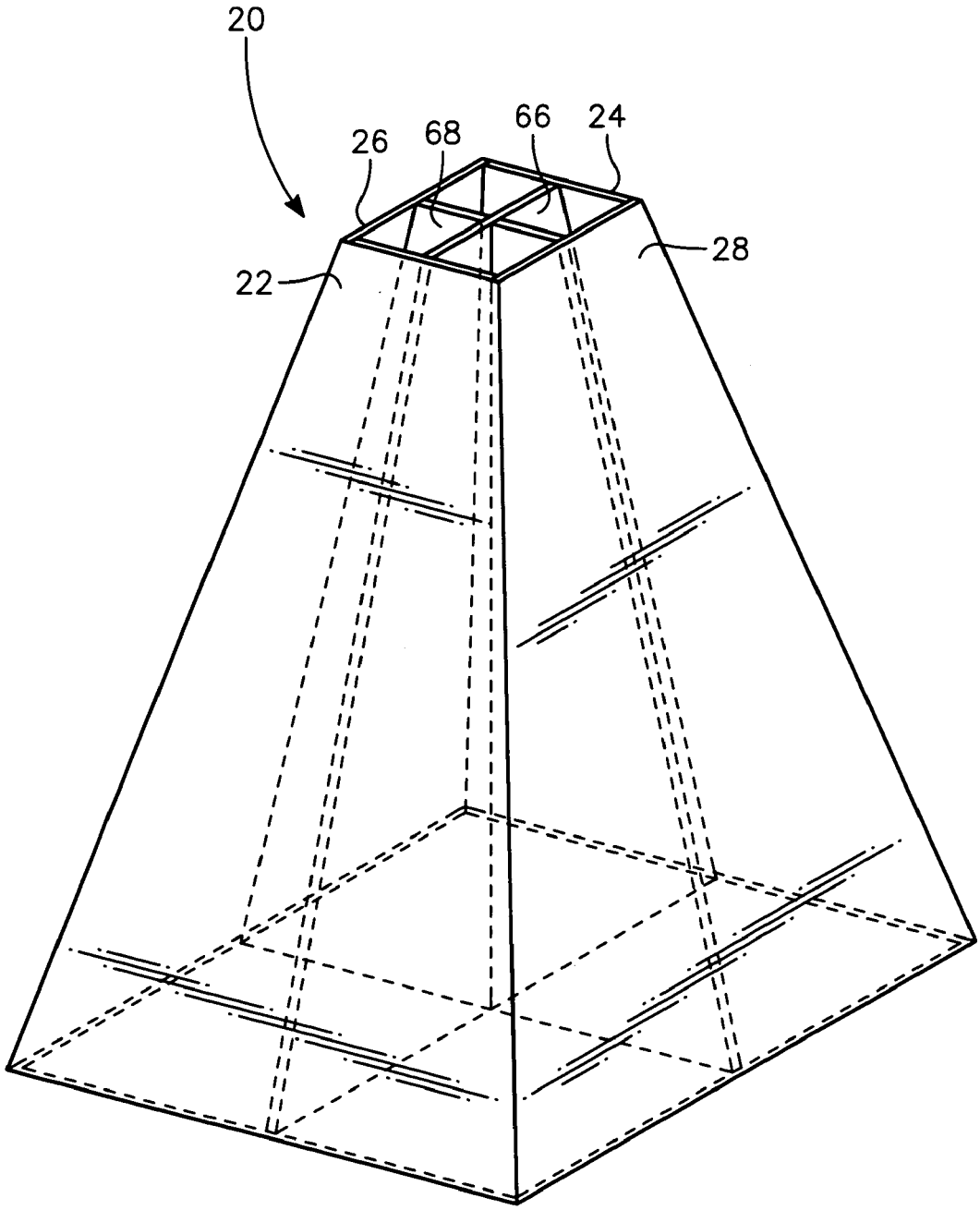
FIG. 10 is a perspective view of the support structure for the dual polarized broadband tapered slot antenna of FIG. 1 and the placement of the microstrip antenna boards within the support structure.

Referring to FIGS. 6 and 7, the dual polarized broadband tapered slot antenna includes two microstrip antenna boards 66 and 68 illustrated respectively in FIG. 6 and FIG. 7. As shown in FIG. 6, microstrip antenna board 66 has a planar upper surface 70 with a radiating metallic antenna element 72 (sometimes referred to as a Vivaldi antenna) and a dielectric substrate 74. The radiating metallic antenna element 72 is fabricated by electrochemical deposition of copper on the dielectric substrate 74. The dielectric substrate 74 may be any dielectric or ceramic material composite, fiberglass reinforced material and the like Referring to FIG. 10, FIG. 10 illustrates the antenna support structure 20 for the dual polarized broadband tapered slot antenna of FIG. 1 and the placement of the microstrip antenna boards 66 and 68 within antenna support structure 20. As shown in FIG. 10, the antenna boards 66 and 68 are co-located within support structure 20 and affixed to the side walls 22, 24, 26 and 28 of the support structure 20, with the antenna boards 66 and 68 being positioned perpendicular to one another.

A tapered notch area 76 is formed on the planar upper surface 70 of antenna board 66 by etching away a tapered portion of the metallic antenna element 72. The tapered notch area 76 extends from the rounded edges 78 of metallic antenna element 72 to one end of a slot line 80 located at the narrow end of the tapered notch 76. The opposite end of slot line 80 terminates in a Y connection which includes a slot line short circuited stub 82 formed from one arm of the Y connection and a slot line open circuited stub 84 formed from the other arm of the Y connection.

Figure 8:
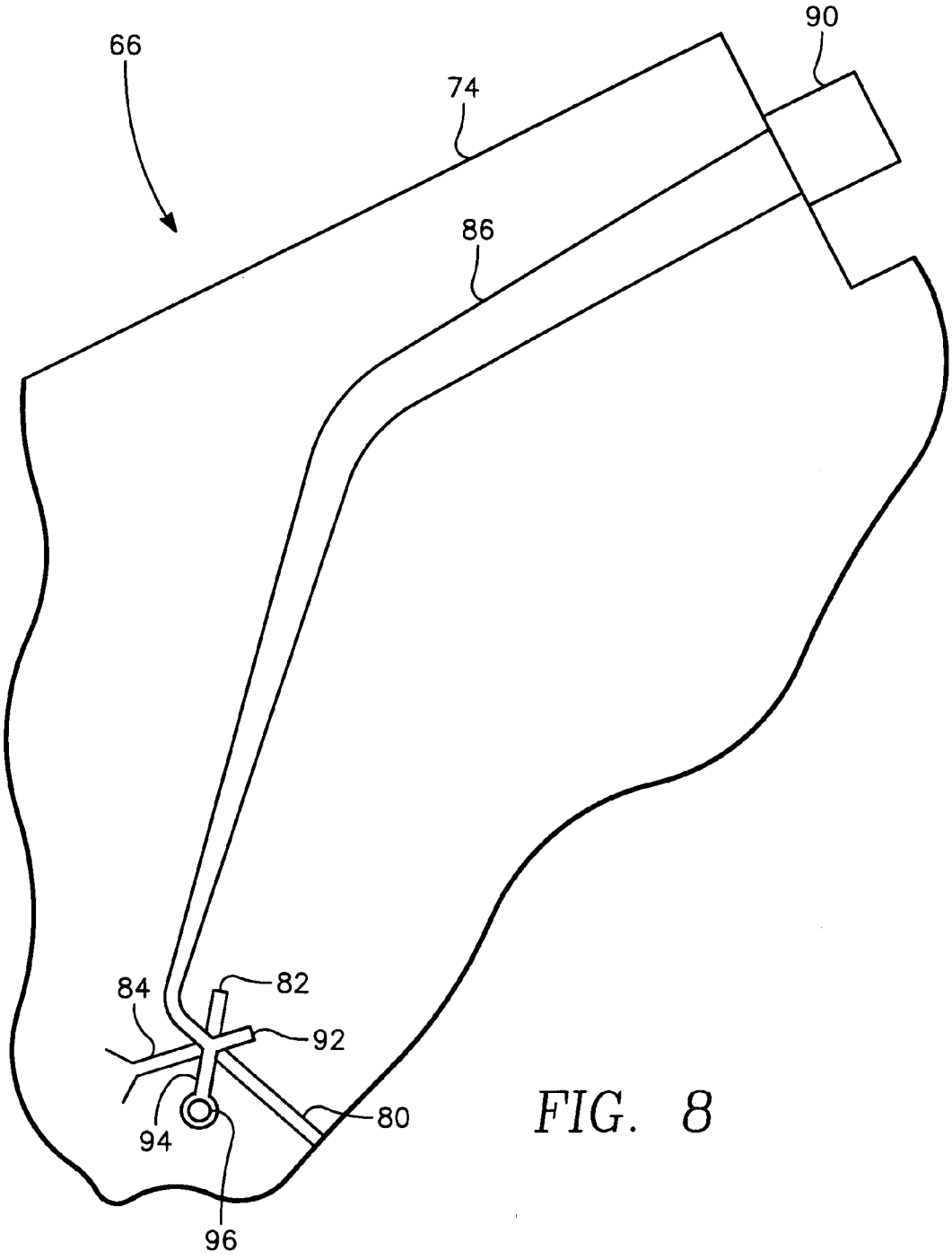
FIGS. 8–9 are views illustrating the feed lines for first and second tapered slot antennas of FIGS. 6 and 7.

Referring to FIGS. 6 and 8, a microstrip copper feed line 86 is mounted on the lower surface 88 of dielectric substrate 74 in the manner illustrated in FIG. 8. One end of microstrip copper feed line 86 is terminated by a 50 ohm coax cable connector 90 and the opposite of microstrip copper feed line 86 also terminates in a Y connection. The Y connection for microstrip copper feed line 86 includes a microstrip open circuited stub 92 and a microstrip short circuited stub 94 which connects to the radiating metallic antenna element 72 via a copper plated through hole 96. The connection of feed line 86 to slot line 80 is referred to as Y—Y microstrip to slot line transition. The electrical length of each arm of the Y for feed line 86 is the same to allow for proper operation of the Y—Y microstrip to slot line transition for the tapered notch antenna 72 at the high end of the frequency range which is approximately 18 gigahertz. The physical length of the arms differs because the open circuited stub 92 has capacitance on its end which requires that the open circuited stub 92 be shorter in length than the short circuited stub 94.

In a like manner, the electrical length of each arm of the Y for slot line 80 is the same and is also the same as the electrical length of each arm of the Y for microstrip feed line 86.

The impedance of the mcirostrip line 86 tapers to 100 ohms.

The metallic antenna element 72 radiates when the width of the notch as manifested by the taper 76 becomes excessively wide. The radiation is controlled by the taper with frequency of an RF signal being from 1.5 GHZ (gigahertz) at the wide end 78 of the taper 76 to 18 GHZ at the narrow end 79 of the taper 76. The antenna is designed to transmit and receive RF signals. The dielectric substrate 74 helps to confine electric fields to the region of the taper 76.

Figure 9:
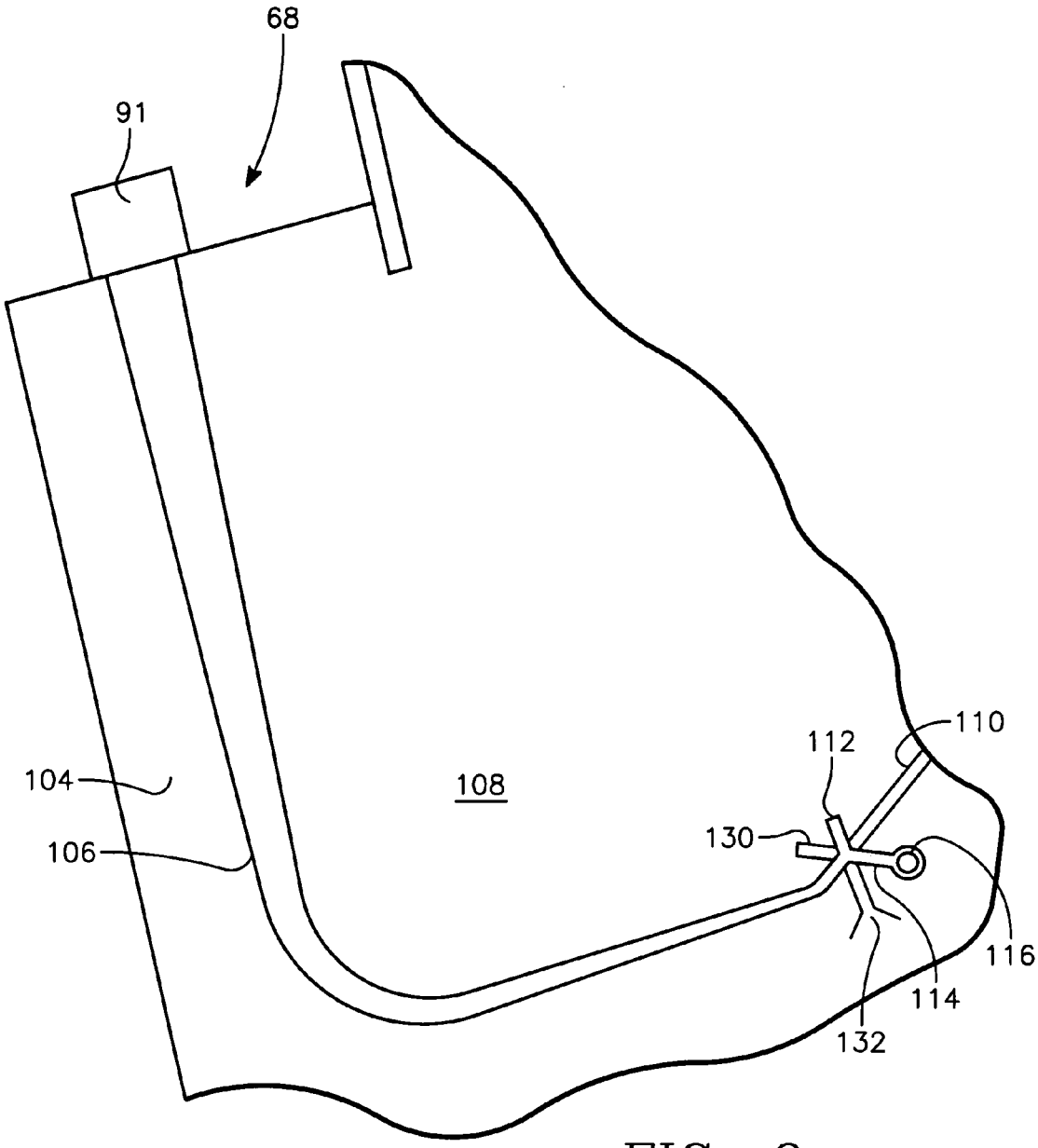

Referring to FIGS. 7 and 9, a microstrip copper feed line 106 is also mounted on the lower surface 108 of dielectric substrate 104 in the manner illustrated in FIG. 9. One end of microstrip copper feed line 106 is terminated by a 50 ohm coax cable connector 91 and the opposite end of copper feed line 106 terminates in a Y connection. The Y connection for microstrip copper feed line 106 includes a microstrip open circuited stub 112 and a microstrip short circuited stub 114 which connects to the radiating metallic antenna element 126 via a copper plated through hole 116. The connection of feed line 106 to slot line 110 is also a Y—Y microstrip to slot line transition. The electrical length of each arm of the Y for feed line 106 is the same to allow for proper operation of the Y—Y microstrip to slot line transition for the tapered notch antenna 126 at the high end of the frequency range which is approximately 18 gigahertz. The physical length of the arms differs because the open circuited stub 112 has capacitance on its end which requires that the open circuited stub 112 be shorter in length than the short circuited stub 114.

In a like manner, the electrical length of each arm of the Y for slot line 110 is the same and is also the same as the electrical length of each arm of the Y for microstrip feed line 106.

The impedance of the mcirostrip line 106 tapers to 100 ohms.

Referring to FIGS. 6 and 7, the dielectric substrate 74 of antenna board 66 has a centrally located slot 98 which extends from the wide end 78 of taper 76 to near the end of slot line 80. Antenna board 68 is inserted into slot 98 of dielectric substrate 74 such that antenna boards 66 and 68 are co-located, orthogonally polarized and positioned perpendicular to one another. Antenna board 68 also has a centrally located slot 120 at the upper end of antenna board 68. At the bottom end of antenna board 68 is a cutout/opening 122, which approximates a trapezoid. Slot 120 and cutout 122 are used to facilitate insertion of antenna board 68 into the slot 98 of antenna board 66 and position the antenna boards perpendicular to one another.

Referring to FIGS. 7 ad 9, the top side of antenna board 68 includes radiating metallic antenna element 126 and tapered notch area 124 which is formed on the planar upper surface 128 of antenna board 68 by etching away a tapered portion of the metallic antenna element 126. Antenna board 68 also has slot line 110 which terminates in a Y connection. The Y connection for slot line 110 includes a slot line short circuited stub 130 formed from one arm of the Y connection and a slot line open circuited stub 132 formed from the other arm of the Y connection.

Referring to FIGS. 1–7, antenna boards 66 and 68 each have two alignment tabs 134 and 136 on the side opposite their feed lines and one alignment tab 138 on the side which includes their feed lines. The alignment tabs 134 and 136 are inserted into rectangular shaped openings 140 and 142, respectively, in side walls 22 and 26. The alignment tabs 138 are inserted into the rectangular shaped openings 144 in side walls 24 and 28. Side walls 24 and 28 each have slot 146 at their upper end which centrally located and extends downward into the side walls 24 and 28. The portion of antenna boards 66 and 68 which includes their microstrip feed lines 86 and 106 and associated 50 ohm coax cable connectors 90 and 91 passes through slots 146 extending outward from side walls 24 and 28. Cable connectors 90 and 91 allows a user to connect an external RF signal cable to antenna boards 66 and 68.

At this time it should be noted that the copper trace of the tapered notch antennas 72 and 126 functions as a ground for the microstrip feed lines 86 and 106.

Each antenna board 66 and 68 also has an outer routing path 148 and 150, respectively. The outer routing paths 148 and 150 are formed around the periphery of the antenna boards 66 and 68. The routing paths 148 and 150 assist the manufacture of the boards in fabricating the boards 66 and 68 to fit within the antenna support structure 20 formed by side walls 22, 24, 26 and 28.

The tapered notch antennas/radiating metallic antenna elements 72 and 126 allow for linear polarization, elliptical polarization and right or left circular polarization. Polarization can be either horizontal or vertical. For circular polarization, the signals fed to the microstrip feed lines 86 and 106 will differ to provide for a ninety degree phase shift between the signals transmitted on microstrip feed lines 86 and 106. For linear polarization only one of the two tapered notch antennas 72 or 126 is excited.

Tapered notch antennas 72 and 126 create at an electric aperture at the current frequency of operation. The lowest frequency of operation occurs at the rounded edges 78 of antenna 72 and the rounded edges 105 of antenna 126 which is defined as the mouth of antennas 72 and 126. As the frequency of operation rises radiation occurs in the narrow widths of the tapered notch areas 76 and 124. Radiation generally begins at one quarter of wavelength in width at the mouth of antennas 72 and 126 and will continue as long as the slot has a width of one quarter wavelength. The antenna pattern provided by antennas 72 and 126 is a single lobe antenna pattern and the width of the mouth is configured to maintain the pattern. Rounded edges 78 and 105 prevent diffractions in the radiation pattern.

The antennas 72 and 126 are designed to radiate at the same phase. This necessitates that the slot lines 80 and 110 for antenna boards 66 and 68 and the microstrip lines 86 and 106 be configured as illustrated in FIGS. 6 and 8 from the coax cable connector elements 90 and 91 to a like point in the tapered section of the antennas 72 and 126 and have the same electrical lengths. An external antenna coupler can be used to provide a ninety degree phase shift between the signal fed to microstrip feed line 86 and the signal fed to microstrip feed line 106 to achieve circular polarization. For linear polarization only one antenna 72 or 126 is excited.

The two copper traces of each antenna 72 and 126 are phase shifted by 180 degrees which creates an electric field across the tapers 76 and 124 of antenna boards 66 and 68.

From the foregoing, it may readily be seen that the present invention comprises a new unique and exceedingly useful dual polarized broadband tapered slot antenna which constitutes a considerable improvement over the known prior art. Obviously many modifications and variations of the present invention are possible in light of the above teachings. It is therefore to be understood that within the scope of the appended claims that the invention may be practiced otherwise than specifically described.

What is claimed is:

1. A dual polarized broadband tapered slot antenna comprising:

(i) a support structure having first, second, third and fourth dielectric side walls, each of the side walls of said support structure having a trapezoidal shape, the first, second, third and fourth side walls of said support structure being configured to have a rectangular shaped base, and a rectangular shaped upper end; and (ii) a pair of antenna boards co-located within said support structure and affixed to said support structure, said first and second antenna boards being positioned perpendicular to one another, each of said first and second antenna boards including:

(a) a dielectric substrate;

(b) a tapered slot antenna mounted on an upper surface of the dielectric substrate for said first and second antenna boards, said tapered slot antenna for said first and second antenna boards having a radiating metallic antenna element mounted on the upper surface of the dielectric substrate for said first and second antenna boards and a centrally located tapered slot which consists of a portion of said radiating metallic antenna element etched away to expose said dielectric substrate; and (c) a microstrip feed line mounted on a lower surface of the dielectric substrate for said first and second antenna boards, said microstrip feed line for said first and second antenna boards being connected to said radiating metallic antenna element for said first and second antenna boards by a copper plated through hole which passes through the dielectric substrate for said first and second antenna boards.

2. The dual polarized broadband tapered slot antenna of claim 1 wherein said dual polarized broadband tapered slot antenna is operational over a frequency range of 1.5 GHZ (gigahertz) to 18 GHZ.

3. The dual polarized broadband tapered slot antenna of claim 2 wherein the radiating metallic antenna element for each of said first and second antenna boards operates at a first frequency of 1.5 GHZ at an upper end of said tapered slot and a second frequency of 18 GHZ at a lower end of said tapered slot.

4. The dual polarized broadband tapered slot antenna of claim 3 wherein the radiating metallic antenna element for each of said first and second antenna boards have a frequency of operation which increases from said first frequency of 1.5 GHZ to said second frequency of 18 GHZ as said tapered slot narrows from the upper end of said tapered slot to the lower end of said tapered slot.

5. The dual polarized broadband tapered slot antenna of claim 1 wherein the microstrip feed line for said first and second antenna boards includes a fifty ohm coax cable connector attached to one end which allows a user to connect an external RF signal cable to said microstrip feed line.

6. The dual polarized broadband tapered slot antenna of claim 1 wherein the microstrip feed line for said first and second antenna boards includes a Y shaped connector formed at an opposite end of said microstrip feed line wherein Y shaped connector has a first arm which is an open circuit stub and a second arm which is a short circuit stub wherein the short circuit stub includes said copper plated through hole which connects said microstrip feed line for said first and second antenna boards to said radiating metallic antenna element for said first and second antenna boards.

7. The dual polarized broadband tapered slot antenna of claim 1 wherein said dual polarized broadband tapered slot antenna provides for circular polarization of RF signals radiated by said dual polarized broadband tapered slot antenna when the radiating metallic antenna elements of said first and second antenna boards are simultaneously excited by RF electrical signals supplied to the radiating metallic antenna elements of said first and second antenna boards.

8. The dual polarized broadband tapered slot antenna of claim 1 wherein said dual polarized broadband tapered slot antenna provides for elliptical polarization of RF signals radiated by said dual polarized broadband tapered slot antenna when the radiating metallic antenna elements of said first and second antenna boards are simultaneously excited by RF electrical signals supplied to the radiating metallic antenna elements of said first and second antenna boards.

9. The dual polarized broadband tapered slot antenna of claim 1 wherein said dual polarized broadband tapered slot antenna provides for linear polarization of RF signals radiated by said dual polarized broadband tapered slot antenna when only one of the radiating metallic antenna elements of said first and second antenna boards is excited by RF electrical signals supplied to said dual polarized broadband tapered slot antenna.

10. A dual polarized broadband tapered slot antenna comprising:

(i) a support structure having first, second, third and fourth dielectric side walls, each of the side walls of said support structure having a trapezoidal shape, the first, second, third and fourth side walls of said support structure being configured to have a rectangular shaped base, and a rectangular shaped upper end;

(ii) a pair of antenna boards co-located within said support structure and affixed to said support structure, said first and second antenna boards being positioned perpendicular to one another, each of said first and second antenna boards including:

(a) a dielectric substrate;

(b) a tapered slot antenna mounted on an upper surface of the dielectric substrate for said first and second antenna boards, said tapered slot antenna for said first and second antenna boards having a radiating metallic antenna element mounted on the upper surface of the dielectric substrate for said first and second antenna boards and a centrally located tapered slot which consists of a portion of said radiating metallic antenna element etched away to expose said dielectric substrate; and (c) a microstrip feed line mounted on a lower surface of the dielectric substrate for said first and second antenna boards, said microstrip feed line for said first and second antenna boards being connected to said radiating metallic antenna element for said first and second antenna boards by a copper plated through hole which passes through the dielectric substrate for said first and second antenna boards, said microstrip feed line consisting of a fifty ohm coax cable connector attached to one end and a Y shaped microstrip connector formed at an opposite end, said Y shaped microstrip connector having a first arm which is an open circuit stub and a second arm which is a short circuit stub wherein the short circuit stub includes said copper plated through hole which connects said microstrip feed line for said first and second antenna boards to said radiating metallic antenna element for said first and second antenna boards;

(iii) said dual polarized broadband tapered slot antenna providing for circular polarization of RF signals radiated by said dual polarized broadband tapered slot antenna when the radiating metallic antenna elements of said first and second antenna boards are simultaneously excited by RF electrical signals supplied to the radiating metallic antenna elements of said first and second antenna boards; and (iv) said dual polarized broadband tapered slot antenna providing for linear polarization of RF signals radiated by said dual polarized broadband tapered slot antenna when only one of the radiating metallic antenna elements of said first and second antenna boards is excited by RF electrical signals supplied to said dual polarized broadband tapered slot antenna.

11. The dual polarized broadband tapered slot antenna of claim 10 wherein said dual polarized broadband tapered slot antennas operational over a frequency range of 1.5 GHZ (gigahertz) to 18 GHZ.

12. The dual polarized broadband tapered slot antenna of claim 11 wherein the radiating metallic antenna element for each of said first and second antenna boards operates at a first frequency of 1.5 GHZ at an upper end of said tapered slot and a second frequency of 18 GHZ at a lower end of said tapered slot.

13. The dual polarized broadband tapered slot antenna of claim 12 wherein the radiating metallic antenna element for each of said first and second antenna boards have a frequency of operation which increases from said first frequency of 1.5 GHZ to said second frequency of 18 GHZ as said tapered slot narrows from the upper end of said tapered slot to the lower end of said tapered slot.

14. The dual polarized broadband tapered slot antenna of claim 10 wherein the tapered slot of the radiating metallic antenna element for said first and second antenna boards includes a slot line which extends from a narrow end of said tapered slot, said slot line terminating in a Y which has a first arm forming a slot line short circuit stub and a second arm forming a slot line open circuit stub.

15. The dual polarized broadband tapered slot antenna of claim 10 wherein said fifty ohm coax cable connector attached to one end of said microstrip feed line for said first and second antenna boards allows a user to connect an external RF signal cable to said microstrip feed line.

16. A dual polarized broadband tapered slot antenna comprising:

(i) a support structure having first, second, third and fourth dielectric side walls, each of the side walls of said support structure having a trapezoidal shape, the first, second, third and fourth side walls of said support structure being configured to have a rectangular shaped base, and a rectangular shaped upper end;

(ii) a pair of antenna boards co-located within said support structure and affixed to said support structure, said first and second antenna boards being positioned perpendicular to one another, each of said first and second antenna boards including:

(a) a dielectric substrate;

(b) a tapered slot antenna mounted on an upper surface of the dielectric substrate for said first and second antenna boards, said tapered slot antenna for said first and second antenna boards having a radiating metallic antenna element mounted on the upper surface of the dielectric substrate for said first and second antenna boards and a centrally located tapered slot which consists of a portion of said radiating metallic antenna element etched away to expose said dielectric substrate;

(c) a microstrip feed line mounted on a lower surface of the dielectric substrate for said first and second antenna boards, said microstrip feed line for said first and second antenna boards being connected to said radiating metallic antenna element for said first and second antenna boards by a copper plated through hole which passes through the dielectric substrate for said first and second antenna boards, said microstrip feed line consisting of a fifty ohm coax cable connector attached to one end and a Y shaped microstrip connector formed at an opposite end, said Y shaped microstrip connector having a first arm which is an open circuit stub and a second arm which is a short circuit stub wherein the short circuit stub includes said copper plated through hole which connects said microstrip feed line for said first and second antenna boards to said radiating metallic antenna element for said first and second antenna boards; and (d) said radiating metallic antenna element and said microstrip feed line for said first and second antenna boards being fabricated from copper plate;

(iii) said dual polarized broadband tapered slot antenna providing for circular polarization of RF signals radiated by said dual polarized broadband tapered slot antenna when the radiating metallic antenna elements of said first and second antenna boards are simultaneously excited by RF electrical signals supplied to the radiating metallic antenna elements of said first and second antenna boards;

(iv) said dual polarized broadband tapered slot antenna providing for linear polarization of RF signals radiated by said dual polarized broadband tapered slot antenna when only one of the radiating metallic antenna elements of said first and second antenna boards is excited by RF electrical signals supplied to said dual polarized broadband tapered slot antenna; and (v) said dual polarized broadband tapered slot antenna being operational over a frequency range of 1.5 GHZ to 18 GHZ.

17. The dual polarized broadband tapered slot antenna of claim 16 wherein the radiating metallic antenna element for each of said first and second antenna boards operates at a first frequency of 1.5 GHZ at an upper end of said tapered slot and a second frequency of 18 GHZ at a lower end of said tapered slot.

18. The dual polarized broadband tapered slot antenna of claim 17 wherein the radiating metallic antenna element for each of said first and second antenna boards have a frequency of operation which increases from said first frequency of 1.5 GHZ to said second frequency of 18 GHZ as said tapered slot narrows from the upper end of said tapered slot to the lower end of said tapered slot.

19. The dual polarized broadband tapered slot antenna of claim 16 wherein the tapered slot of the radiating metallic antenna element for said first and second antenna boards includes a slot line which extends from a narrow end of said tapered slot, said slot line terminating in a Y which has a first arm forming a slot line short circuit stub and a second arm forming a slot line open circuit stub.

20. The dual polarized broadband tapered slot antenna of claim 16 wherein said fifty ohm coax cable connector attached to one end of said microstrip feed line for said first and second antenna boards allows a user to connect an external RF signal cable to said microstrip feed line.

* * * * *